US005361539A

United States Patent [19]

Widener

[11] Patent Number: 5,361,539

[45] Date of Patent: Nov. 8, 1994

[54] DOOR SECURING MECHANISM

[76] Inventor: Charles D. Widener, 43–410 Old Harbour Dr., Bermuda Dunes, Calif. 92201

[21] Appl. No.: 61,171

[22] Filed: May 12, 1993

[51] Int. Cl.[5] ..... E05B 65/06; E05C 19/18

[52] U.S. Cl. ..... 49/394; 292/258; 292/288

[58] Field of Search ..... 49/394, 503; 292/258, 292/288, DIG. 15, DIG. 19

[56] References Cited

U.S. PATENT DOCUMENTS

| | | | |
|---|---|---|---|
| 3,997,206 | 12/1976 | Hagopian | 292/258 X |
| 4,078,835 | 3/1978 | Spencer | 292/258 X |
| 4,198,088 | 4/1980 | Tochihara | 292/288 |
| 4,330,146 | 5/1982 | Sessions, Jr. | 292/258 |
| 4,405,165 | 9/1983 | Johns | 292/258 |
| 4,653,785 | 3/1987 | Tobey | 292/258 |

*Primary Examiner*—Philip C. Kannan
*Attorney, Agent, or Firm*—Marvin H. Kleinberg

[57] ABSTRACT

A demountable door securing device includes a door edge engaging plate with a right angled bend adapted to rest against one face of the door and an extended portion terminating in a hinge on the opposite side of the door. A rotating door engaging member including a planar portion and a right angled portion can be rotated to engage a face of the door. A security bar through apertured tabs in the extended portion prevents rotation of the planar portion. The right angled bend includes an extended bar portion parallel to the door face at the free end of which a hasp is pivotally mounted. The hasp rotates into engagement with the door frame and is held in place by a securing bar extending outward from the right angled bend. A tongue on the free end of the securing bar fits through an aperture in the hasp and holes in the tongue can receive a locking device.

20 Claims, 4 Drawing Sheets

DOOR SECURING MECHANISM

The present invention relates to door securing devices and, more paticularly, to a demountable door securing device that can be installed for release from either side of the door.

BACKGROUND OF THE INVENTION

Many situations require a mechanism to immobilize a door in the closed position where locks have not heretofore been installed on the door or where keys to previously installed locks are not sufficiently controlled to prevent unauthorized entry. For example, construction sites, prior to completion, may use completed rooms with doors for the temporary storage of building materials and it is desirable that access be limited to authorized personnel.

Similarly, office buildings, hotels and hospitals may wish to secure, temporarily, otherwise unoccupied rooms which may not be provided with locks. Further, for those rooms with locks, it may be desirable to secure such rooms temporarily against use by persons who would normally have keys and therefore unrestricted access. Persons sharing living space such as multiple bedroom houses or apartments may wish to control access to rooms or closets without installing permanent locking devices. Condominium owners who permit rental of their dwelling may wish to keep personal property in room or closets without affording access to the renters and without wishing to install disfiguring locking arrangements.

Landlords may wish a simple device to bar entry to delinquent tenants or to protect property pending a change of the lock or in the event of damage to the lock as the result of an unauthorized forcible entry. Other instances will come to mind of situations where it would be desirable to have an easily demountable device that can be attached to a door and which can be quickly secured and released, using a padlock or a quick release pin, from either side, no matter which way the door opens.

Prior art devices have been proposed and generally fall into three categories: 1) Devices which are installed on an accessible side of the door and which engage the floor or a wall to resist movement of the door; 2) devices which are installed on the outside of an inwardly opening door and which provide a bar against the frame to hinder door opening; and 3) devices which are installed on a door frame or stop, but which can be secured from either side.

Patents illustrating devices of the first type include the patents to Tochihara, U.S. Pat. No. 4,198,088; Wilson, U.S. Pat. No. 4,560,192; Hudec, et al, U.S. Pat. No. 4,653,140; and Bell, U.S. Pat. No. 4,657,293. Patents teaching devices of the second type include the patents to Hudon, U.S. Pat. No. 3,181,319; Hagopian, U.S. Pat. No. 3,997,206; Sessions, Jr., U.S. Pat. No. 4,330,146; Vidas, U.S. Pat. No. 4,585,259; and Tobey, U.S. Pat. No. 4,653,785.

The patent to Johns, U.S. Pat. No. 4,405,165, illustrates the third type of device and includes a planar member for engaging one of the planar surfaces of the door and a tongue member extending from the planar member and adapted to protrude through the space between the door and the jamb when the door is closed. A collar plate fits over the tongue member and engages both the other planar surface of the door and the door stop portion of the frame. The planar member includes a sliding plate which can be brought into engagement with the door stop on the door frame. Means are provided for locking both the collar plate and the sliding plate so that the door can be secured from either side.

While the Johns device appears to be universal in its application, it has shortcomings. For one thing, a door stop can frequently be a thin strip of wood that is fastened to a door frame with small finishing nails and may not withstand any forceful attempt to open the door.

For example, to secure an inwardly opening door from the outside, which is, by far, the most common situation, one must mount the door jamb engaging member to straddlingly grip the door stop portion of the jamb. This is accomplished by positioning the end edge of the flat plate so that it overlays the side edge of the door stop shoulder with a projection that is provided on the flat plate. The collar ring, previously adjusted and locked with a set screw so that the distance between it and the flat plate is just slightly greater than the width of the door stop shoulder.

The set screw is then tightened against the shoulder, fixing the flat plate in place. The door engaging member is then slid into place and the tabs are aligned so that a lock or pin can be placed in aligned apertures. The door is then closed with the tongue protruding from the space between the door edge and the jamb. The collar plate is then slid onto the tongue and a lock is passed through aligned apertures in the tongue and plate. It is clear that if the thickness of the door is greater than the length of the tongue, the collar plate cannot be locked in place.

To open the door from the inside, the lock or pin is removed from the aligned tabs and the set screw against the door stop must be released. In an emergency, apparatus to release the set screws may not be readily available.

To lock an outwardly opening door from the inside, door engaging member is placed on the door and the collar plate is fastened to the tongue with a pin, bolt or lock. The door is then closed and the door jamb engaging member is slid into engagement with the door engaging member. The collar ring is then secured to the door stop with the set screw and a bolt or lock is placed through the aligned apertures.

As can be seen, the door jamb engaging portion requires some tool to engage the set screws which makes for a semipermanent installation on the door frame. Further, until the set screws are released from the door stop, the device cannot be easily deactivated from the "inside" in an emergency. In addition, the device requires separable parts that must be properly fitted and secured, not only to the door frame but to each other. The door jamb engaging member can also be a hazard because it will protrude into the door opening at a height that may strike passers by.

What is needed and what is provided by the present invention is a demountable door securing device that is unitary, can be released from both sides and which can be frictionally held at a convenient height. It would also be desirable for the device to be universal so that it can be installed on any door, no matter which side it is hinged.

SUMMARY OF THE INVENTION

In accordance with the present invention, a new and improved temporary demountable door securing device is disclosed as including a first or outside locking element and a second or inside locking element. In the preferred embodiment, the outside locking element includes a flat arm that extends parallel to the door surface to which is mounted a pivoted locking bar. The locking bar extends toward the door frame but at an angle so that it may rest against the door frame. A securing arm extends away from the door and includes a curved portion whose radius of curvature approximates the distance from the arm to the pivot point. The locking bar includes an aperture through which the securing arm can pass. Holes in the securing arm can receive a lock or other securing element that maintains the locking bar in engagement with the door frame.

The second element, which is an extension of the first locking element, includes a door edge engaging portion adapted to fit between the door and the jamb. The element extends from the door engaging portion to a hinge, to which is fitted a rotating l-shaped member. The l-shaped member rotates to an open or rest position in which the one portion is parallel to the door engaging portion and the bent portion is parallel to the door surface. When the l-shaped member is rotated approximately 180° about the hinge, the portion parallel to the door engaging portion rests against that portion and the outwardly extending element is next adjacent the door surface.

All surfaces adjacent the door may be fitted with a deformable layer that protects the finish of the door to which the combination is applied and which adds sufficient friction to prevent the combination from sliding down the door edge under the forces of gravity. In addition, the door facing element can be cut out to accept a spring clip that can be easily adjusted so that the assembly will tightly grasp doors of varying thickness.

Both the inside and outside locking elements can be made to receive either a padlock or a hook or rod that can be easily removed. In the preferred embodiment, the second locking element includes a pair of upper and lower tabs on a movable element. The tabs are apertured to receive a locking bar which holds the movable element in place. When the movable element is rotated out of the securing position, the tabs are conveniently out of the way.

In an alternative embodiment, the second locking element can be fitted with a u-shaped clamping member that slides over the portions adjacent the hinge, which prevents the hinge from opening. Holes through the u-shaped clamping member match holes in the second locking element so that the clamping member can be held in place. The u-shaped clamp can be applied to either edge, normally being fitted to the "top" edge.

If the primary use of the device is to secure a door from one side only, as in an occupied room, the lock would only be used on the side from which entry is to be restricted and the occupied side could be provided with a simple pin or other quick release mechanism. Other applications may require locks on both sides of the door.

Accordingly, it is an object of the invention to provide an improved demountable door securing device.

It is an additional object of invention to provide a door securing device that may be used with any door without regard to the direction of door swing.

It is yet an additional object of the invention to provide a demountable door securing device that can be quickly and easily secured and opened from either side of the door using either a pin, a lock or other locking device.

It is a further object of invention to provide a demountable door securing device that engages the door frame against the stop and which releasably holds the device to the door on the opposite side.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DETAILED DESCRIPTION OF THE INVENTION

Figure 1:
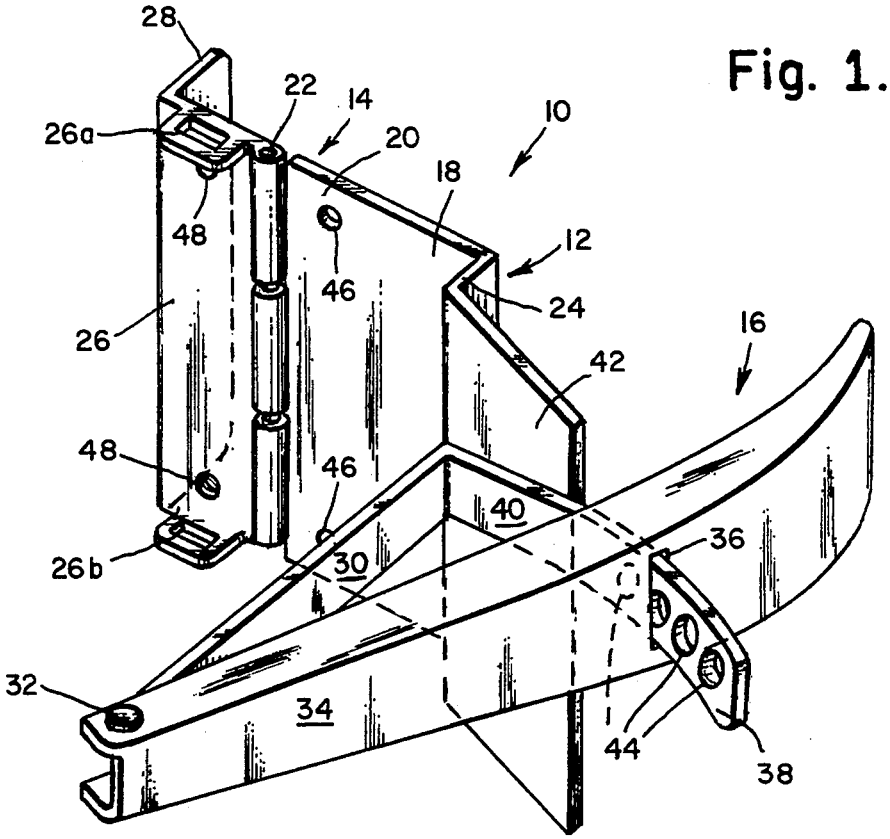
FIG. 1 is a perspective view of the demountable door securing device of the present invention.
Figure 2:
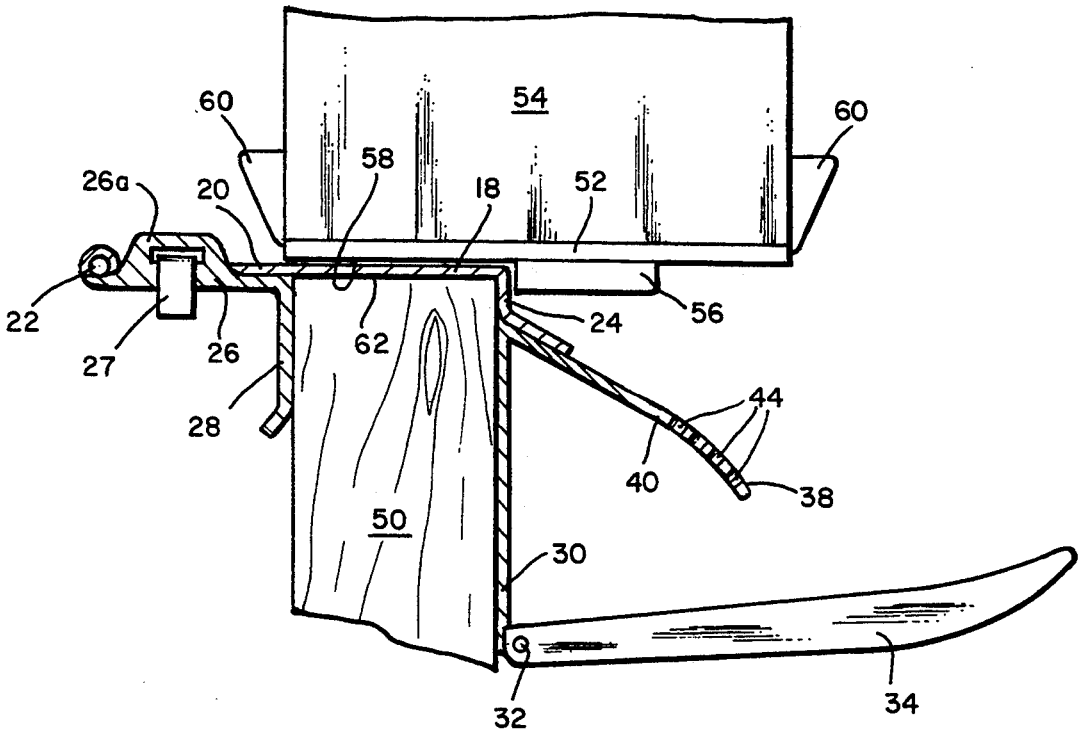
FIG. 2 is a top sectional view of a door and frame upon which is mounted the door securing device of FIG. 1.

Turning first to FIGS. 1 and 2, there is shown a demountable door securing device 10 according to the present invention. The device 10 is intended to be fitted to the free edge of a conventional door (best seen in connection with FIG. 2) and includes a door engaging portion 12, in interior securing portion 14, and an exterior frame engaging portion 16.

The door engaging portion 12 includes a door edge portion 18, which is adapted to fit between a door edge and the jamb of the frame in which the door is mounted. The edge portion 18 includes an extended coplanar portion 20 which terminates in an open side hinge 22. On the opposite side of the edge portion is a right angle bend 24 which engages the flat surface of the door.

Mounted to the open side hinge 22 is a plate 26 with a right angled bend 28, comprising the interior securing portion 14. When the plate 26 is rotated about the hinge 22 so that it is parallel to and adjacent the extended coplanar portion 20, the right angled bend 28 is coplanar with and adjacent to a door surface. In such an orientation, the door engaging portion 12 can mount to the door.

In the preferred embodiment, the plate 26 includes upper and lower tabs **26*a*, 26*b* which are slotted to receive a locking bar 27. The locking bar 27 can have a molded handle (not shown) or an angled bend at one end to limit its travel through the slots and has an aperture at the lower end to receive a lock 29 to prevent upward withdrawal of the bar 27 through the slots. Alternatively, the aperture can be relocated to work cooperatively with a suitably placed apertures in the coplanar portion 20 and the plate 26 so that the shackle of lock 29** will secure all of the elements together.

The door contacting surfaces of the device 10 can be fitted with various materials that will increase friction and prevent marring or scratching of the door surface. When so mounted, so long as the right angled bend is restrained from rotating, the door securing device 10 can remain on the door as it opens and closes.

The exterior frame engaging portion 16 includes a door plate 30 which can be an extension of the first right angled bend portion 24. The free end of the door plate 30 is a pivot 32 about which swings a frame engaging bar or hasp 34. The frame engaging bar or hasp 34 has an aperture 36 through which a tongue 38 can pass.

The tongue 38 is an extension of a curved securing bar 40 which is mounted to a substantially right angled extension 42 of the first right angled bend 24. The angle of mounting of the securing bar 40 should permit easy clearance with the door jamb when the door is opened with the device 10 in place.

As may be appreciated from the foregoing description, elements of the device of the present invention can be bent from a single piece of metal. For example, door plate 30, tongue 38 and securing bar 40 can be fabricated as parts of an integral metal structure. A series of locking apertures 44 are placed in the tongue 38 so that door frames of different widths can be accommodated. A securing aperture 46 can be placed in the extended coplanar portion 20 and aligned with a corresponding aperture 48 in the plate 26 in the secured configuration.

As best seen in FIG. 2, a door 50 is mounted in a conventional door frame 52 which is inset into a wall 54, a portion of which is shown for reference. As with most door and frame combinations, a door stop shoulder 56 is provided in the jamb 58 and the frame 52 is finished with one or more moldings to create an entry facade 60.

When the demountable securing device 10 is mounted on the door edge, the "interior" securing portion 14 has the plate and angled bend 26, 28 rotated so that the bend 28 abuts a surface of the door 50. In this configuration, the door 50 is free to open and close, with the edge portion 18 of the device 10 fitting in the space between the jamb 58 and the free edge 62 of the door 50. The frame engaging bar or hasp 34 is free to move and does not affect the swing of the door 50.

Figure 3:
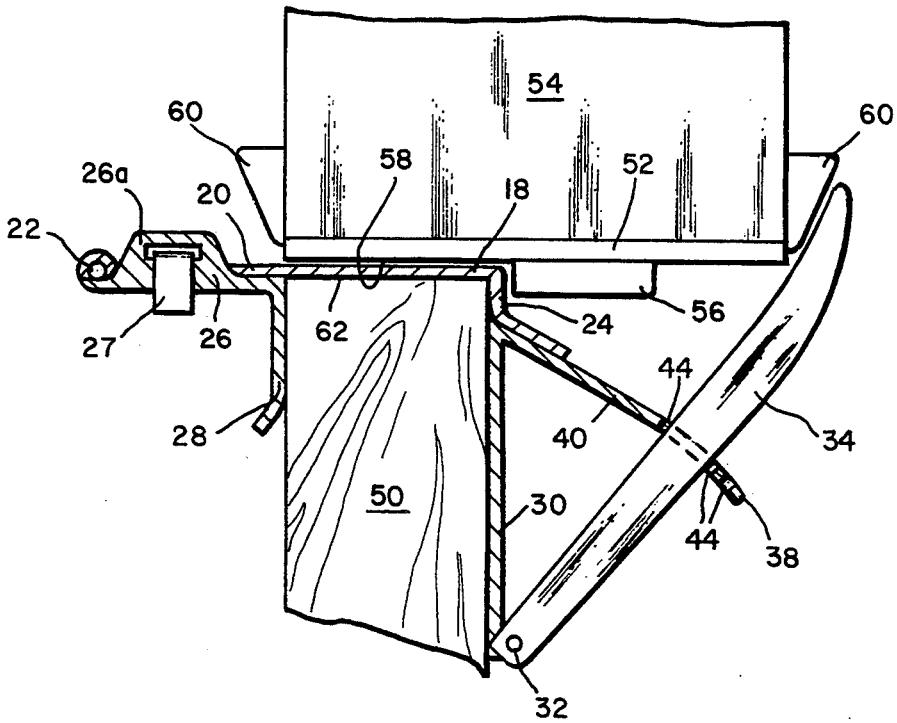
FIG. 3 is a top view of the device of FIG. 2 in a fully secured configuration.

As shown in FIG. 3, to secure the door 50 in the closed and latched position, the door 50 is closed and the frame engaging bar or hasp 34 is rotated until the tongue 38 enters the aperture 36 as the free end of the frame engaging bar or hasp 34 bears upon the facade 60. The frame engaging bar or hasp 34 need not be in tight engagement with the facade 60 so long as one or more of the locking apertures 44 of the tongue 38 have passed through the aperture 36 of the frame engaging bar or hasp 34 and a security device, such as a lock (not shown), is passed through a locking aperture 44. Similarly, a security device (not shown) may be passed through matching apertures 46, 48 in the plate 26 and the extended coplanar portion 20.

If now an attempt is made to open the door 50, the frame engaging bar or hasp 34 is held by the facade 60 and the door 50 is retained in the securing device 10 by the angled bend 28 of the interior securing portion 14. However, the door 50 can be released from either side.

If it is desired to release the door 50 from the interior, the bar 27 can be removed, releasing plate 26 to rotate with the angled bend 28 until it is coplanar with extended portion 20. This brings the angled bend 26 out of contact with a door surface. The door 50 is then free to swing on its hinges and its arc will allow the door edge 62 to clear the pivot 32. The securing device 10 is then free of the door and, if not restrained, will fall to the floor.

If the door 50 is to be released from the exterior, the security device is removed from the tongue 38 and the frame engaging bar or hasp 34 rotates away from the facade 60. The door 50 is then free to swing on its hinges, this time with the door securing device 10 frictionally held to the door edge 62.

As an alternative to the tabs **26*a*, 26*b* and the locking bar 27, a u-shape security member may be slid over the extended coplanar portion 20 and the plate 26 to keep the right angled bend 28 in engagement with the surface of the door 50. The security member may also have apertures which are aligned with the securing apertures 46, 48 in the plate 26 and coplanar portion 20** as mentioned above to receive a lock or other security device.

Figure 4:
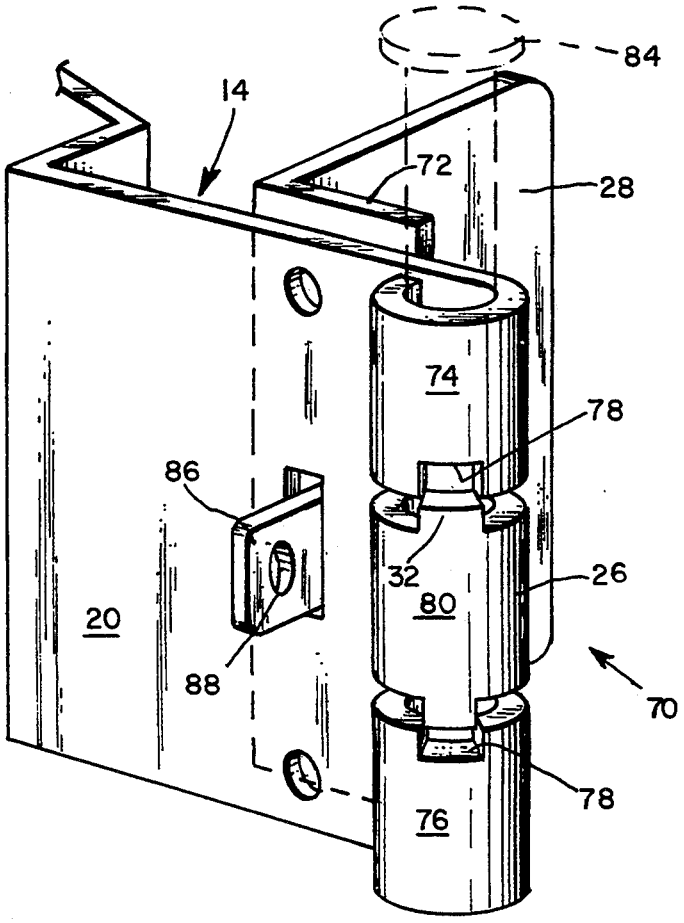
FIG. 4 is a perspective view of an alternative mechanism for releasably securing the opening side of a door.

Turning to FIG. 4, there is shown an alternative structure for an interior securing portion 14'. In this embodiment, a modified hinge 70 is provided in which a modified plate 72 rotates. The upper and lower fixed portions of the hinge 74, 76 are provided with a one or more crenelations 78. The rotating portion 80 incudes a opposed pair of teeth 82 which can fit into a crenelation 78. The fixed portions 74, 76 are separated by a distance slightly greater than the axial length of the rotating portion 80 including the opposed teeth 82.

In order to rotate the hinge 70, the rotating element 80 must be moved axially on a pivot pin 84 to a point midway between the upper and lower fixed portions 74, 76 before it can be released for rotation. This type of hinge has a limited number of stable, locked orientations. In the preferred embodiment, only the "closed", immovable orientation is provided. When not in the secured or "closed" orientation, the hinge is free to pivot and a stable or locked "open" configuration is not provided.

In order to secure the hinge, alternatives are illustrated. A pair of apertures through the coplanar portion 20 and the modified plate 72 can receive a securing device which will prevent axial movement of the hinge 70. Alternatively, a single, centrally located elongated aperture on the extended coplanar portion 20 can receive a tab 86 extending from center of the modified plate 72. An aperture 88 in the tab 86 may receive a securing device. Either will suffice to retain the secured configuration.

Figure 5:
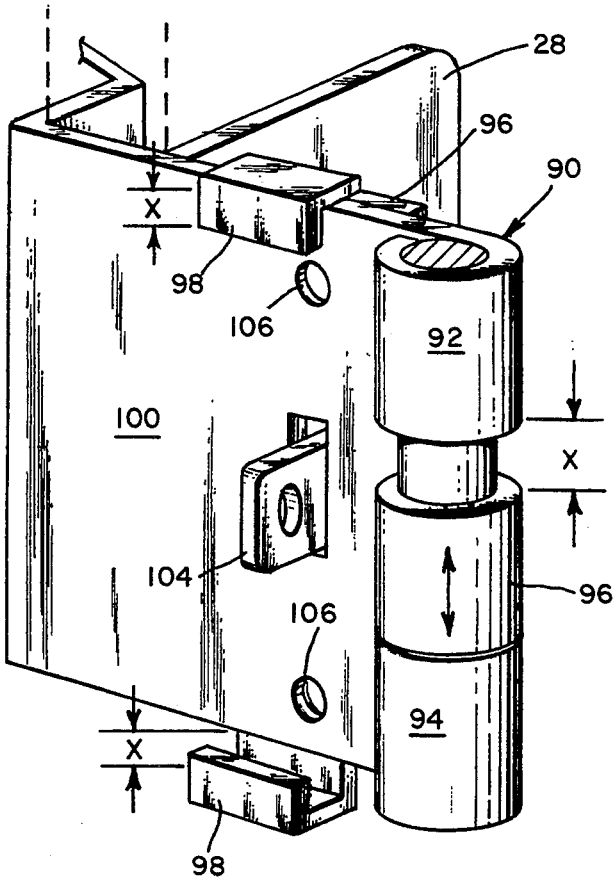
FIG. 5 is a perspective view of a second alternative mechanism for releasably securing the opening side of a door.

An alternative configuration for the hinge is shown in FIG. 5. Here, the hinge 90 merely has a gap between the fixed elements 92, 94. A modified plate 96 is provided with an l-shaped flange 98 which for symmetry, is on both the upper and lower edges. In order to secure the door, the plate 96 is raised until the flange 98 is free of a coplanar portion 100. The plate 96 is then free to rotate. In the secure configuration, shown in FIG. 5, the flange 98 holds the plate 96 against the coplanar portion 100.

The embodiment of FIG. 5 is provided with alternative securing features. An aperture 102 is cut into the co planar portion 100. A tab 104 is provided on the plate 96 and has an opening to receive a security device such as a lock. The tab 104 can either be added to the plate 96 or can be a portion of the plate which has been cut out and folded outward. Alternatively, locking apertures 106 through which a security device can be placed can be provided in the coplanar portion 100 and the plate 96.

Figure 6:
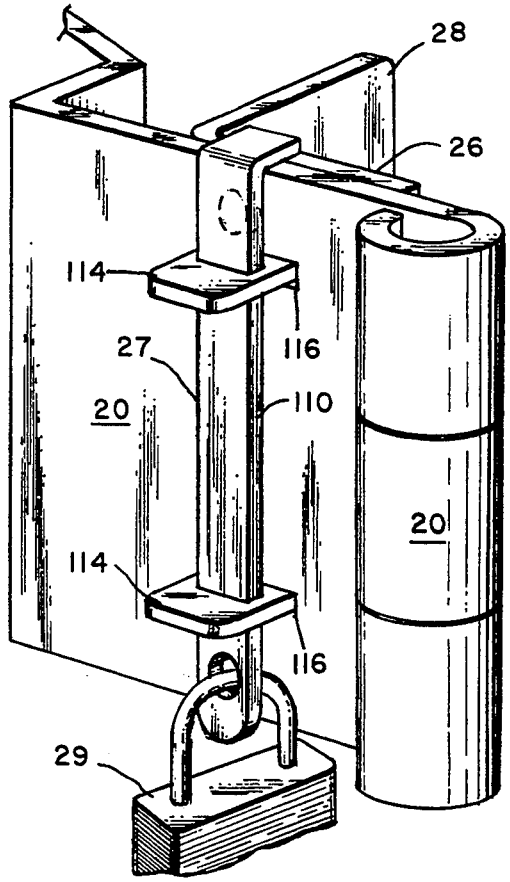
FIG. 6 is a perspective view of a third alternative mechanism for releasably securing the opening side of a door.

In FIG. 6, a locking bar 110 with an integral flange portion 112 is provided to hold the plate against the co planar portion. In this embodiment, however, a pair of horizontally oriented tabs 114 and pass through horizontal slots 116 in the coplanar member and are held in place by a security device such as the lock 29, can fasten the bar 110 to the remainder of the device through an aperture in the bar 110 and corresponding apertures in the upper and lower part of the coplanar member and plate. As will be readily appreciated, the combination is intended to be symmetrical about a horizontal axis so that it can be installed on either side of a door.

Figure 7:
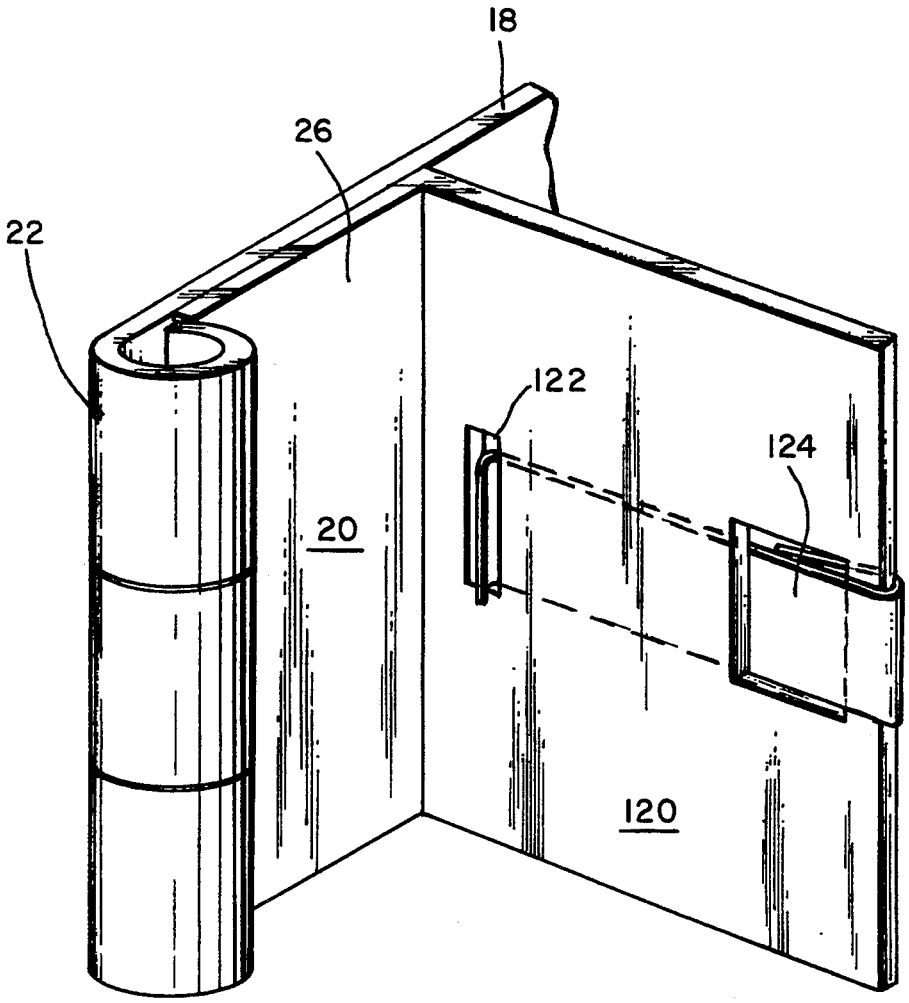
FIG. 7 is a perspective view of a door engaging plate having an adjustable spring finger for holding the apparatus in place on doors of varying thicknesses.

Turning next to FIG. 7, there is shown a modified angled bend element 120 of the interior securing portion. An opening 122 is cut from the angled bend element 120. A spring steel finger element 124 is fitted into the opening and can, through manual adjustment, apply sufficient spring bias to hold the entire device in place on a door whose thickness may differ from that for which the device was designed. A coating may be placed on the surface next to the door to protect the door and to add an element of friction.

Thus there has been shown and described a door securing device which includes an "exterior" portion which is adapted to be held against the facade part of a door frame which is usually on adjacent the door stop. The device includes an "interior" portion which captures the door in the device.

When the interior portion is released, the door is free to swing open on its hinges. The device must be held against falling since it is no longer fastened to anything. When the exterior portion is released, the door is free to swing, but the device remains fastened to the door and will move with it.

Variations have been shown which provide alternative methods of fastening the interior portion of the device. Also, a variation has been shown which includes integral spring fingers to insure a snug fit against a door whose thickness may vary from the standard thickness. Other modifications and variations will occur to those skilled in the art. Moreover, the device has been made to be usable on either side of a door by merely inverting the device. All fastening and securing elements are useful in either orientation.

Accordingly, the scope of the invention should be limited only by the following claims.

What is claimed is:

1. A door securing device adapted to maintain, in a closed position, a door hingedly mounted in a door frame including a door stop shoulder, the door including a first face adapted to rest against the door stop shoulder, a second face and a free edge, the securing device comprising:

a. a door edge member adapted to fit between the door edge and the frame and extending away from the door frame with a first hinge at the extended end;

b. a first door face engaging portion extending from said door edge member substantially parallel to the first door face and terminating in a second hinge;

c. a hasp pivotally mounted to said second hinge and extending toward the door frame and adapted to engage the door frame;

d. securing means for releasably maintaining said hasp in engagement with the door frame; and e. a second door face engaging member pivotally mounted to said first hinge for releasably holding the door in said door edge member, whereby the door cannot be opened when held in the securing device by said door face engaging members with said hasp in engagement with the door frame and whereby the door can be opened by either releasing said hasp from the door frame or by disengaging said second door face engaging member.

2. The securing device of claim 1 wherein said securing means include a bar member attached to said door edge member adapted to be fastened to said hasp to maintain said hasp in engagement with the door frame.

3. The securing device of claim 2 wherein said bar member has a tongue element and wherein said hasp has an aperture adapted to receive said tongue element.

4. The securing device of claim 3 wherein said tongue element includes openings to receive a locking device for preventing rotation of said hasp out of engagement with the door frame.

5. The door securing device of claim 1, wherein said second door face engaging member has a bend enabling a portion of said member to be parallel to said door edge member and said bend to be parallel to the second door face.

6. The door securing device of claim 1, further including second securing means for said second door face engaging member to maintain said member in engagement with the second door face.

7. The securing device of claim 6 wherein said second securing means include first and second apertured tab members attached to said door edge member extending toward the door hinge and a security bar adapted to fit through said apertures for preventing rotation of said second door face engaging member out of engagement with the second door face.

8. The securing device of claim 6 wherein said second securing means include aligned apertures in said door edge member and said second door face engaging member to receive a locking device to prevent rotation of said second door face engaging member out of engagement with the second door face.

9. The securing device of claim 6 wherein said second securing means include a u-shaped clip member adapted to capture said second door face engaging member and said door edge member between the legs of the u to prevent rotation of said second door face engaging member out of engagement with the second door face.

10. The securing device of claim 6 wherein said second securing means include a tab extending from said door edge member adapted to fit within a corresponding aperture in said second door face engaging member, said tab including an opening to receive a locking device to prevent rotation of said second door face engaging member out of engagement with the second door face.

11. The securing device of claim 1 further including biasing means including a spring finger mounted to said second door face engaging member and adapted to bear against the second door face.

12. The securing device of claim 11 wherein said second door face engaging member includes an aperture to receive said biasing means.

13. A demountable door securing device for temporarily locking a door of the type which is hingedly mounted in a door frame having a jamb, a door stop shoulder and a framing facade surrounding the opening on the side of the frame having the door stop shoulder, the door having parallel faces and an edge which is slightly spaced apart from the jamb when the door is closed, the securing device comprising:

a. a door engaging portion (12) adapted to fit between the door edge and door jamb when the door is closed, said door engaging portion having a bent portion (24) adapted to engage one of the door faces and an extended portion (20) terminating in a first hinge (22);

b. a door capturing portion (14) attached to said first hinge (22) and including a planar plate portion (26) and a bent portion (28) ,adapted to engage the other of the door faces when said plate portion (26) is parallel to said extended portion (20);

c. an apertured hasp member (34) adapted to engage a door frame facade, hingedly mounted to a first extension (30) from said bent portion (24), said first extension (30) being parallel to the one door face and displaced from the door edge toward the door hinge;

d. a bar member (40), extending from said bent portion (24) in a direction generally parallel to the door edge and having, at its free end, an extended tongue portion (38) adapted to pass through said hasp aperture (36);

e. first securing means (26) in said door capturing portion (14) and said planar plate portion adapted to receive a security device; and f. second securing means in said extended tongue portion (38) for receiving a security device to lock said extended tongue portion (38) in said hasp (34), whereby the door can be secured when said hasp (34) is locked while in engagement with the frame facade and said door capturing portion is locked in place, and whereby the door can be freed to open by releasing either said hasp (34) or said door capturing (14) portion.

14. The securing device of claim 13 wherein said bar member tongue portion includes openings to receive a locking device for preventing rotation of said hasp out of engagement with the door frame.

15. The securing device of claim 13 wherein said first securing means include first and second apertured tab members attached to said extended plate portion extending toward the door hinge and a security bar adapted to fit through said apertures for preventing rotation of said planar plate portion out of engagement with the other of the door faces.

16. The securing device of claim 13 wherein said first securing means include aligned apertures in said extended plate portion and said planar plate portion to receive a locking device to prevent rotation of said planar plate portion and bent portion out of engagement with the other of the door faces.

17. The securing device of claim 13 wherein said first securing means include a u-shaped clip member adapted to capture said extended portion and said planar plate portion between the legs of the u to prevent rotation of said planar plate portion and said bent portion out of engagement with the second door face.

18. The securing device of claim 13 wherein said first securing means include a tab extending from said extended portion adapted to fit within a corresponding aperture in said planar plate portion, said tab including an opening to receive a locking device to prevent rotation of said planar plate portion and bent portion out of engagement with the second door face.

19. The securing device of claim 13 further including biasing means including a spring finger mounted to said bent portion and adapted to bear against the one door face.

20. The securing device of claim 19 wherein said bent portion includes an aperture to receive said biasing means.

* * * * *